US005656801A

United States Patent [19]

Goren et al.

[11] Patent Number: 5,656,801

[45] Date of Patent: Aug. 12, 1997

[54] SYSTEM AND A METHOD FOR COUNTING PEOPLE

[75] Inventors: Ehud Goren, Ramat-Gan; Efraim Garti, Gedera, both of Israel

[73] Assignee: Mafiss Ltd., Rishon Lezion, Israel

[21] Appl. No.: 576,692

[22] Filed: Dec. 21, 1995

[51] Int. Cl.[6] ..... B61L 1/16; G06M 7/00; G07G 1/00

[52] U.S. Cl. ..... 235/98 R; 235/98 B; 235/99 R

[58] Field of Search ..... 235/98 R, 98 B, 235/93, 99 R, 99 A

[56] References Cited

U.S. PATENT DOCUMENTS

| | | | |
|---|---|---|---|
| 3,141,612 | 7/1964 | Bolton | 235/99 A |
| 3,346,866 | 10/1967 | Bechtel | 235/99 R |
| 3,627,313 | 12/1971 | Schongeld | 272/57 |
| 3,694,630 | 9/1972 | Dybel | 235/98 R |
| 4,000,400 | 12/1976 | Elder . | |
| 4,122,331 | 10/1978 | Tsubota et al. . | |
| 4,175,446 | 11/1979 | Crowninshield et al. | 73/787 |
| 4,223,887 | 9/1980 | Holtz | 272/70 |
| 4,303,851 | 12/1981 | Mottier . | |

FOREIGN PATENT DOCUMENTS

| | | |
|---|---|---|
| 9100591 | 11/1992 | Netherlands . |
| 1336061 | 9/1987 | U.S.S.R. . |
| 1418780 | 8/1988 | U.S.S.R. . |
| 1441427 | 11/1988 | U.S.S.R. . |

*Primary Examiner*—Michael L. Gellner
*Assistant Examiner*—Daniel Chapik
*Attorney, Agent, or Firm*—Wigman, Cohen, Leitner & Myers, P.C.

[57] ABSTRACT

A system and a method for counting the number of people passing a entry point in a predetermined direction. The system includes a foot-activated, pressure sensitive platform deployed at the entry point for providing a time-dependent pressure profile vector indicative of the manner in which a person arches one of his feet prior to at least partially stepping off the platform. The pressure profile vector is processed for determining whether the person completely passed through the entry point in the predetermined direction. In the affirmative case, a counter for recording the number of people completely passing through the entry point in the predetermined direction is incremented. The system can be adapted for providing a net count of the instantaneous number of people in a given area during the entering and leaving of people through an entry point into and from the given area.

15 Claims, 12 Drawing Sheets

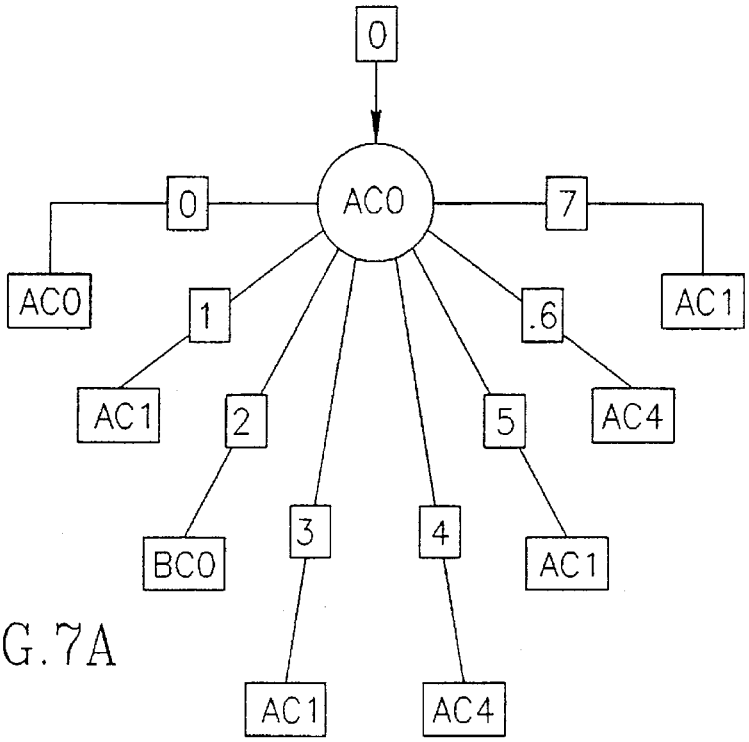
FIG.7A
| | A | B | C |
|---|---|---|---|
| 0 | 0 | 0 | 0 |
| 1 | 1 | 0 | 0 |
| 2 | 0 | 1 | 0 |
| 3 | 1 | 1 | 0 |
| 4 | 0 | 0 | 1 |
| 5 | 1 | 0 | 1 |
| 6 | 0 | 1 | 1 |
| 7 | 1 | 1 | 1 |
FIG.6
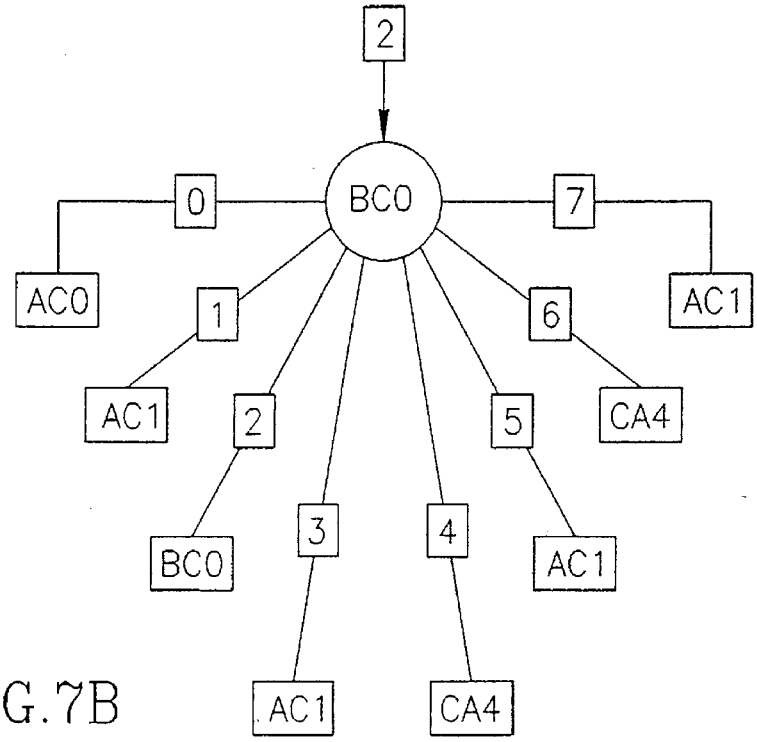
FIG.7B

| LINE | SENSOR MAT A | SENSOR MAT B | SENSOR MAT C | CONFIGURATION | | STATE |
|---|---|---|---|---|---|---|
| 1 | 0 | 0 | 0 | 0 | (0,0,0) | AC0 |
| 2 | $X_1$ | 0 | 0 | 1 | (1,0,0) | AC1 |
| 3 | $X_1$ | $X_1$ | 0 | 3 | (1,1,0) | AC1 |
| 4 | 0 | $X_1$ | 0 | 2 | (0,1,0) | BC1 |
| 5 | 0 | $X_1,Y_1$ | 0 | 2 | (0,1,0) | BC1 |
| 6 | 0 | $X_1,Y_1$ | $Y_1$ | 6 | (0,1,1) | BC2 |
| 7 | 0 | $X_1$ | $Y_1$ | 6 | (0,1,1) | BC2 |
| 8 | 0 | $X_1$ | 0 | 2 | (0,1,0) | BC1 |
| 9 | 0 | 0 | 0 | 0 | (0,0,0) | AC0 |
| 10 | 0 | $Y_2$ | 0 | 2 | (0,1,0) | BC0 |
| 11 | 0 | $Y_2$ | $Y_2$ | 6 | (0,1,1) | CA4 |
| 12 | 0 | $X_2,Y_2$ | $Y_2$ | 6 | (0,1,1) | CA4 |
| 13 | $X_2$ | $X_2,Y_2$ | $Y_2$ | 7 | (1,1,1) | CA1 |
| 14 | $X_2$ | $Y_2$ | $Y_2$ | 7 | (1,1,1) | CA1 |
| 15 | $X_2$ | 0 | $Y_2$ | 5 | (1,0,1) | CA1 |
| 16 | 0 | 0 | $Y_2$ | 4 | (0,0,1) | CA4 |
| 17 | 0 | 0 | 0 | 0 | (0,0,0) | CA0 |

FIG.8

SYSTEM AND A METHOD FOR COUNTING PEOPLE

FIELD OF THE INVENTION

The invention relates to systems and methods for counting people passing through an entry point. In particular, the invention relates to systems and methods for counting people entering and leaving a given area through an entry point so as to provide the net count of people in the given area.

BACKGROUND OF THE INVENTION

Systems and methods for counting people provide valuable statistical information for a wide range of applications. For example, one application is the need to determine the total number of customers passing through an entrance into a shop. Another application is the need to determine the net number of passengers on a mass transportation vehicle at each point along its route.

Systems adapted for such applications are described in U.S. Pat. Nos. 4,000,400, 4,303,851, SU 1336061, SU 1418780, SU 1441427 and NL 9100591. However, such systems suffer from the drawback that they are incapable of providing accurate information under the working environments in which they are required to operate, for example, confined conditions, the possibility that a person who starts passing through an entrance may turn back, entrances which enable two or more people to pass therethrough simultaneously, and the like.

In particular, U.S. Pat. No. 4,122,331 (Tsubota et al.) describes a device for counting the number of people entering or exiting a given area, including a mat switch having a plurality of normally open independent switches arranged in the form of a ladder and a plurality of resistors each connected to one of the plurality of switches. The switches and the resistors are so configured that the output resistance of the mat switch undergoes a monotonic reduction as switches are successively closed by the pressure of a person's foot as he moves in a predetermined direction along the mat switch. Thus, the change in the output resistance of the mat switch provides an indication as to the person's progress along the mat switch and thus permits the number of people entering or leaving the area to be counted.

In other words, the principle upon which Tsubota et al.'s device is based is that a person's progress along the mat switch can be monitored by an analysis of the change in the resistance of the mat switch as a consequence of a person walking along the mat switch in such a manner that both of the person's feet make consecutive contact with the mat switch. However, there are many environments, particularly in confined areas, in which a landing stage is insufficiently long so as to accommodate a full stride of a person. But, if the mat switch disclosed by Tsubota et al. were to be shortened so as to accommodate less than a full stride, the mat switch would merely provide a one-off instantaneous recording of a person's presence thereon and would not allow determination of whether the person completely passed through the entry point.

It is an object of the invention to provide systems and methods having advantages in the above respects.

SUMMARY OF THE INVENTION

A first object of the invention is to provide a system and a method for counting people passing through an entry point in a predetermined direction having advantages in the above respects.

A second object of the invention is to provide a system and a method for counting people entering and leaving a given area through an entry point so as to provide the net count of people in the given area having advantages in the above respects.

In accordance with a first aspect of the invention, there is provided a system for counting the number of people passing through an entry point in a predetermined direction, the system comprising:

(a) a foot-activated, pressure sensitive platform deployed at the entry point for providing a time-dependent pressure profile vector indicative of the manner in which a person arches one of his feet prior to at least partially stepping off said platform;

(b) a processor for processing said pressure profile vector for determining whether the person completely passed through the entry point in the predetermined direction; and (c) a counter coupled to said processor for recording the number of people completely passing through the entry point in the predetermined direction.

It has been found that even when a person is effectively stationary on a platform, his intended direction of motion can be inferred from the manner in which he arches one or both of his foot prior to his stepping off the platform. Specifically, when a person is standing on a platform with both feet, the complete area of his feet make contact with the platform. Thereafter, as the person begins to step off the platform, he arches one of his feet from the heel end to the toe end in the direction in which he intends to step off the platform before removing his foot from the platform. He then repeats this process for his second or trailing foot. Consequently, a time dependent analysis of the pressure profile vector of one or both of his feet during his stepping off the platform permits a determination as to the direction in which the person is about to step off the platform. This information can therefore be employed so as to determine whether the person completely passes through the entry point. This, of course, represents a very significant advantage over the approach disclosed by Tsubota et al. which requires that a person's physical progress along a relatively long mat switch be monitored for enabling the determination of the direction of his movement.

The platform requires a sufficient number of sensors distributed in such a fashion that, in most cases, a person activates at least three sensors when wholly or partially standing thereon so as to enable the acquisition of the time-dependent pressure profile vector of a person's foot as it arches during a stepping off the platform. The sensors can be implemented as either open/close switches or continuous pressure reading output devices. The sensors can be strip-like extending across at least a portion of the entry point and disposed along the direction of the passage of people through the entry point. Alternatively, the sensors can be dot sensors dispersed over the area of the platform.

The system can be divided into two types depending on the span of the entry point through which people are counted on passing therethrough in the predetermined direction. The first type of system is adapted for one or more side by side entry points each having a span sufficiently narrow that people can pass therethrough in single file only. In preferred embodiment of this type of system, the foot-activated, pressure sensitive platform is dimensioned such that it is may be activated by either the left foot or the right foot of only a single person at any one time. In practice, the dimensions of the active portion of the platform is about 50 cm long by 25 cm wide corresponding to the size of an average step of, say, a bus, a flight of stairs, and the like.

The second type of system is adapted for entry points having a span wide enough that a predetermined two or more number of people can pass therethrough simultaneously. The second type of system further includes a converter for converting the single predetermined number of people wide entry point to an equivalent number of fictitious side-by-side single person wide entry points so as to enable the processor to determine whether each person, who is at least contemplating passing through the entry point, in fact, completely pass therethrough. This conversion is achieved by analysis of the ongoing process of the placement of the people's feet onto the platform and their subsequent removal therefrom. Thus, in the case of a two person wide entry point, the converter converts the ongoing process of placement and removal of up to four feet into two information channels representative of the fictitious side-by-side single person wide entry points.

For an accurate operation of the system, the platform is deployed in such a fashion that a person is obliged to place at least one of his feet thereon while passing through the entry point. Typically, this is best achieved by deploying the platform on a step. In certain applications, for example, counting people getting onto a bus, one of the steps of the bus can be employed for placement of the platform thereon.

In accordance with a second aspect of the invention, there is provided a method for counting the number of people passing through an entry point in a predetermined direction, the method comprising the steps of:

(a) providing a time-dependent pressure profile vector indicative of the manner in which a person arches one of his feet prior to at least partially stepping of a platform;

(b) processing the pressure profile vector for determining whether the person completely passed through the entry point in the predetermined direction; and (c) incrementing a counter for providing a cumulative count of the number of people passing through the entry point in the predetermined direction.

BRIEF DESCRIPTION OF THE DRAWINGS

For a better understanding of the present invention and to show how the same can be carried out in practice, reference will now be made, by way of non-limiting example only, to the accompanying drawings in which:

FIG. 6 shows the legend of the converter of the system of FIG. 5;

FIG. 7A shows the AC0 state of the converter of the system of FIG. 5;

FIG. 7B shows the BC0 state of the converter of the system of FIG. 5;

FIG. 8 illustrates the operation of the converter of the system of FIG. 5.

DETAILED DESCRIPTION OF PREFERRED EMBODIMENTS

Figure 1:
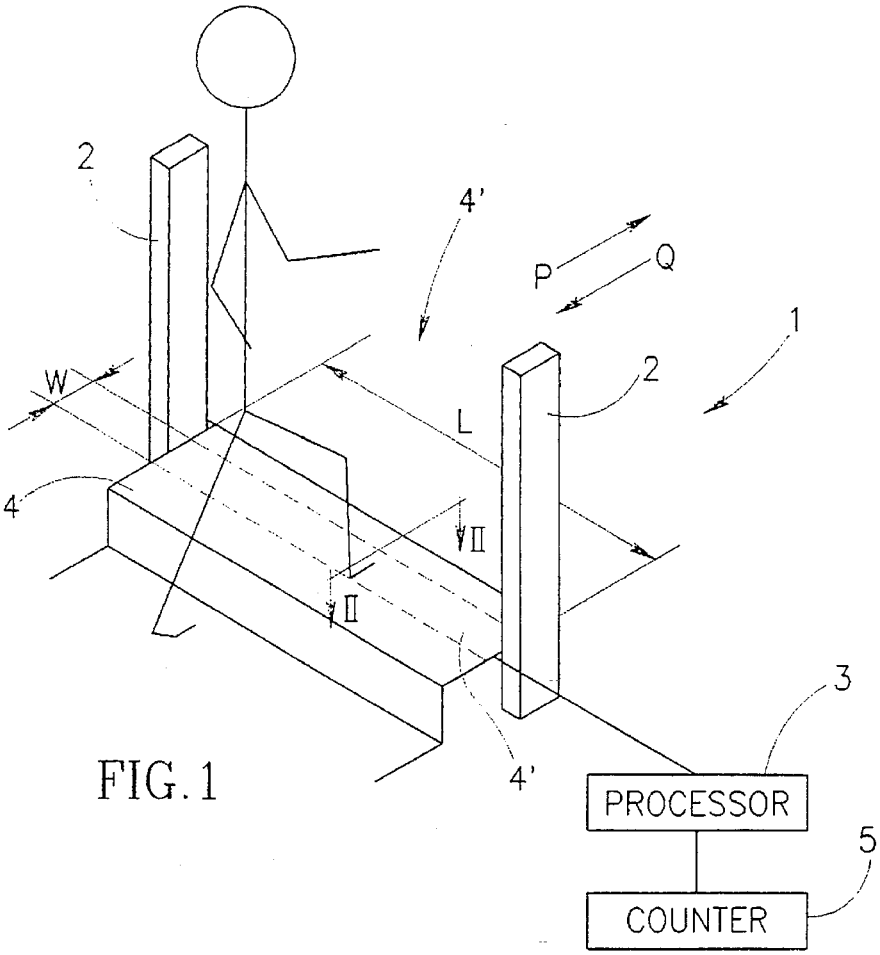
FIG. 1 is a schematic view of a system for counting people passing through an entry point enabling single file passage therethrough.

FIG. 1 shows a system, generally designated 1, for counting people passing through an entry point 2 in the direction P. The entry point 2 is adapted for single file passage therethrough by virtue of having a narrow span of about 80 cm. The system 1 includes a processor 3 for determining whether a person completely passed through the entry point 2 in the direction P from the manner in which the person arches one of his feet prior to stepping off a flexibly resilient platform 4 deployed at the entry point 2. In the affirmative case, the processor 3 increments a counter 5 recording the number of people passing through the entry point 2 in the direction P.

The platform 4 has a generally rectangular shaped active portion 4' having a width "w" defined in the direction parallel to the flow of people passing through the entry point 2 and a length "l" defined in the direction transverse to the flow of people passing through the entry point 2. The width of the active portion 4' is such that it can accommodate only a single person even in crowded conditions whilst the length of the active portion 4' is such that it can be activated by either a left foot or a right foot of a person standing thereon. Thus, the width of the active portion 4' is about 25 cm corresponding to the average length of an adult's foot whilst the length of the active portion 4' is about 50 cm corresponding to the average breadth of an adult. As mentioned earlier, the dimensions of the active portion 4' correspond to the size of an average step enabling the deployment of the platform 4 on a step of a bus, of a flight of stairs, and the like.

Figure 2:
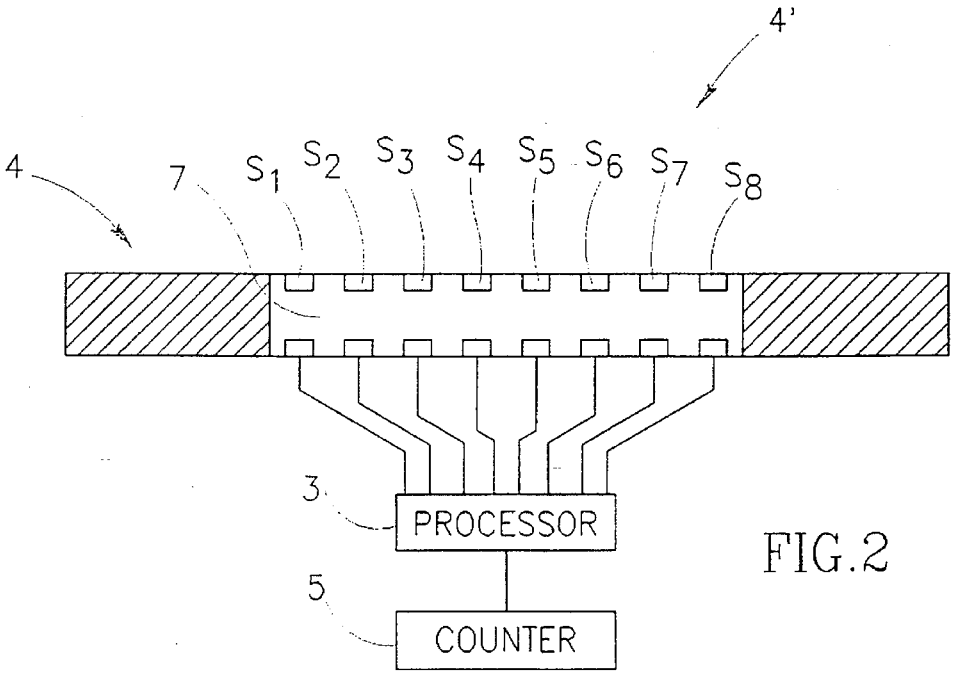
FIG. 2 is a cross-sectional view of a sensor mat of the system of FIG. 1 implemented as an array of strip-like open/close switches.
Figure 3:
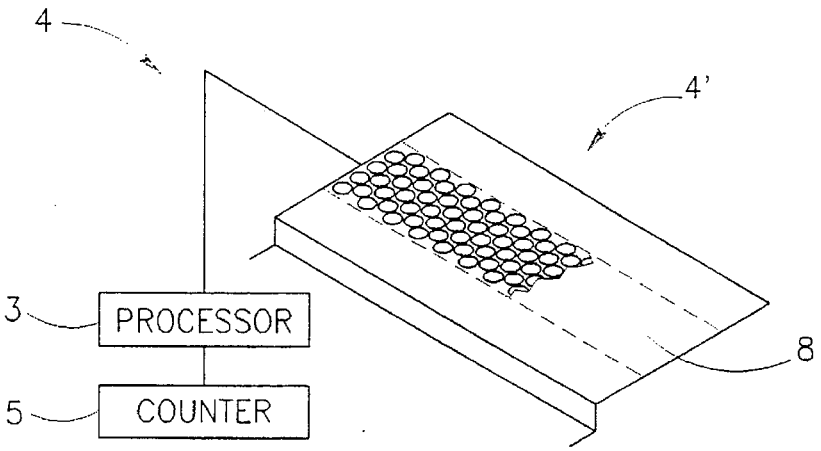
FIG. 3 is a partly cut away view of a sensor mat of the system of FIG. 1 implemented as a matrix of dot sensors.

FIG. 2 shows the active portion 4' implemented as a sensor mat 7 in the form of an array of eight open/close switches $S_1, S_2, \ldots S_8$. The switches $S_1, S_2, \ldots S_8$ are strip-like and extend across at least the central portion of the entry point 2 such that they can be activated by either the left or the right foot of a person standing on the platform 4 as mentioned hereinabove. The switches $S_1$, $S_2$, . . . $S_8$ are deployed along the direction of passage of people through the entry point 2 such that, in most cases, at least three of the switches are activated when a person is standing thereon. FIG. 3 shows the active portion 4' implemented as a sensor mat 8 fashioned from a matrix of uniformly dispersed open/close dot sensors $S_1$, $S_2$, . . . $S_n$. In this case, a foot standing on the sensor mat 8 activates a domain of dot sensors. Both the array of strip-like sensors and the matrix of dot sensors of the active portion 4' can be implemented from pressure sensitive devices providing continuous pressure readings of the pressure applied to each one thereof by a person's foot rather than open/close switches.

The operation of the system 1 for determining the cumulative count of people passing through the entry point 2 in the direction P is now described with reference to the sensor mat 7. It should be noted that the processor 3 is effectively unaware of whether a person is standing with one or both feet on the sensor mat 7. Furthermore, it should be noted that in the event that a person is standing with both feet on the sensor mat 7, the processor 3 is unaware which one of the person's feet is the trailing foot and which one of the person's feet is the leading foot with which the person steps off from the platform 4 first. In other words, in the case of the sensor mat 7, the processor 3 determines whether a person completely passes through the entry point 2 from the manner in which the person arches his trailing foot prior to completely evacuating the sensor mat 7.

The processor 3 periodically acquisitions samples of the switches $S_1$, $S_2$, . . . $S_8$ at high speed arid translates each sample into an index indicative of how person is arching his foot prior to stepping off the platform 4. The samples are translated into indices by assigning the value of 0 to an open switch, the value 1 to switch $S_1$ when closed, the value 2 to switch $S_2$ when closed, and so on and then averaging the combined score of the closed switches. Thus, an index of 2.5 indicates that the instantaneous pressure footprint of a person is more to the left than an index of 6.7 whilst an index of 0 indicates that the sensor mat 7 has been evacuated, namely, when all the switches $S_1$, $S_2$, . . . $S_8$ are open.

The processor 3 compiles a time-dependent pressure profile vector from the indices of a sequence of samples. The processor 3 determines whether the manner in which a person arches one of his feet prior to his stepping off the sensor mat 7 is indicative of a complete passage of a person through the entry point 2 in the direction P by analyzing the pressure profile vector over the last four indices before a complete evacuation of the sensor mat 7 and increments the counter 5 accordingly.

Figure 4A:
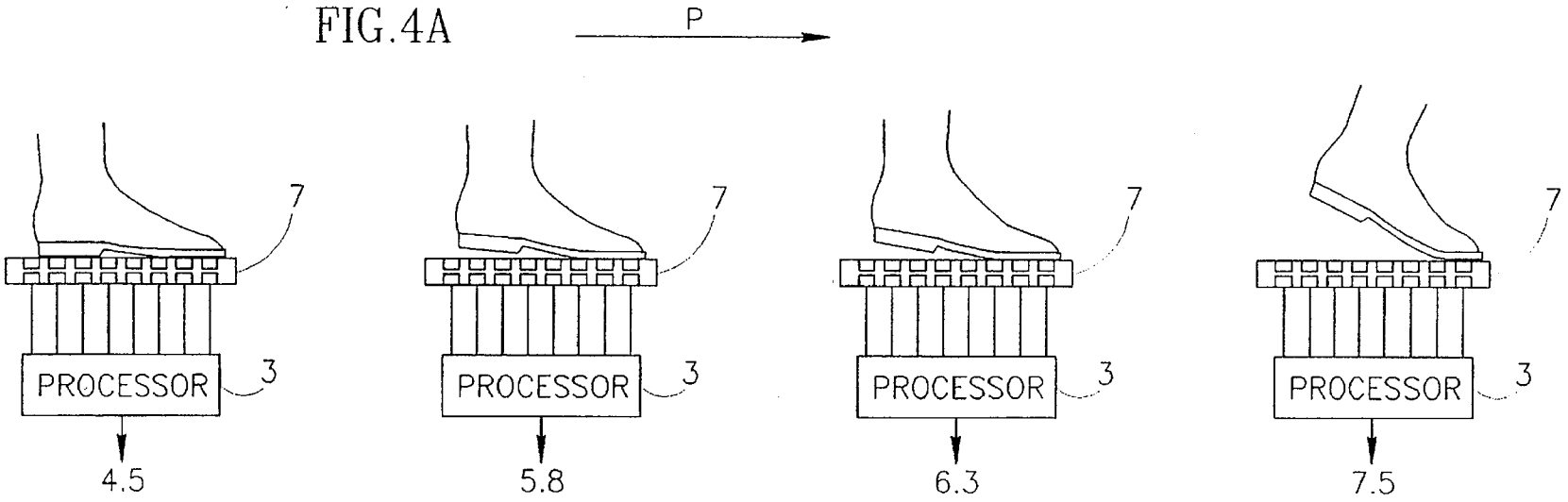
FIG. 4A shows a pressure profile vector for a person arching a foot when stepping off the sensor mat of FIG. 2 in the direction P.
Figure 4B:
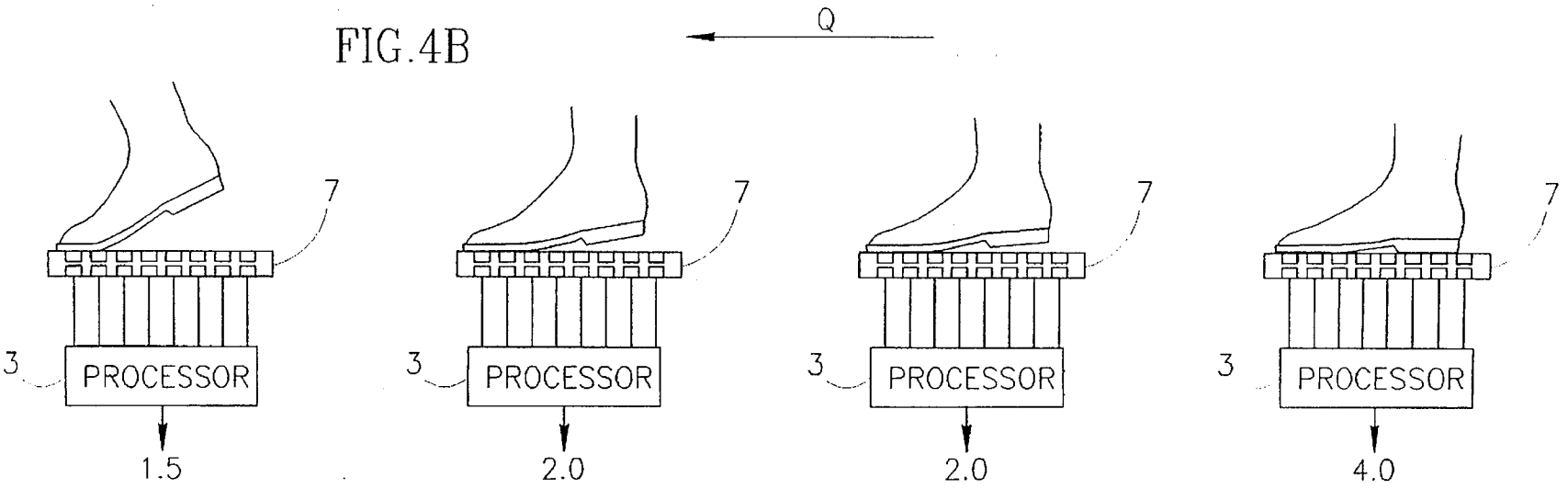
FIG. 4B shows a pressure profile vector for a person arching a foot when stepping off the sensor mat of FIG. 2 in the direction Q.
Figure 4C:
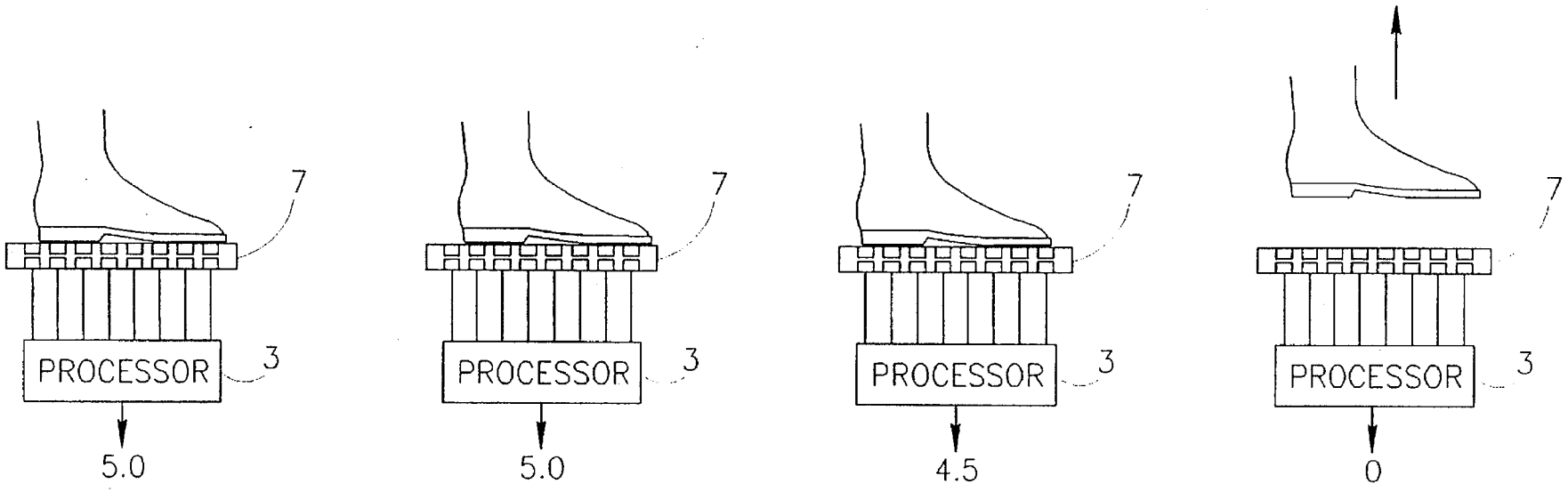
FIG. 4C shows a pressure profile vector for a person lifting his foot off the sensor mat of FIG. 2.

Thus, for example, as shown in FIG. 4A, analysis of a time-dependent pressure profile vector of 4.5, 5.8, 6.3, and 7.5 teaches that a person's foot is being arched in the direction P and therefore indicative of a complete passage of the person through the entry point 2 in that direction. In contrast, as shown in FIG. 4B, analysis of a time-dependent pressure profile vector of 4.0, 2.0, 2.0, and 1.5 teaches that a person's foot is being arched in an opposite direction to the direction P, namely, direction Q and therefore indicative of a complete passage of the person through the entry point 2 in that direction. And lastly, as shown in FIG. 4C, analysis of a time-dependent pressure profile vector of 5.0, 5.0, 4.5 and 0 teaches that a person placed a foot on the sensor mat 7 and thereafter vertically removed his foot but not as part of a step off in either direction P or Q.

The system 1 can be readily adapted for providing the instantaneous number of people in a given area by means of the processor 3 determining a complete passage of a person through the entry point 2 in either the direction P or the opposite direction Q. For such an application, the processor 3 increments the counter 5 when a person is detected as entering the given area and decrements the counter 5 when a person is detected as leaving the given area.

Figure 5:
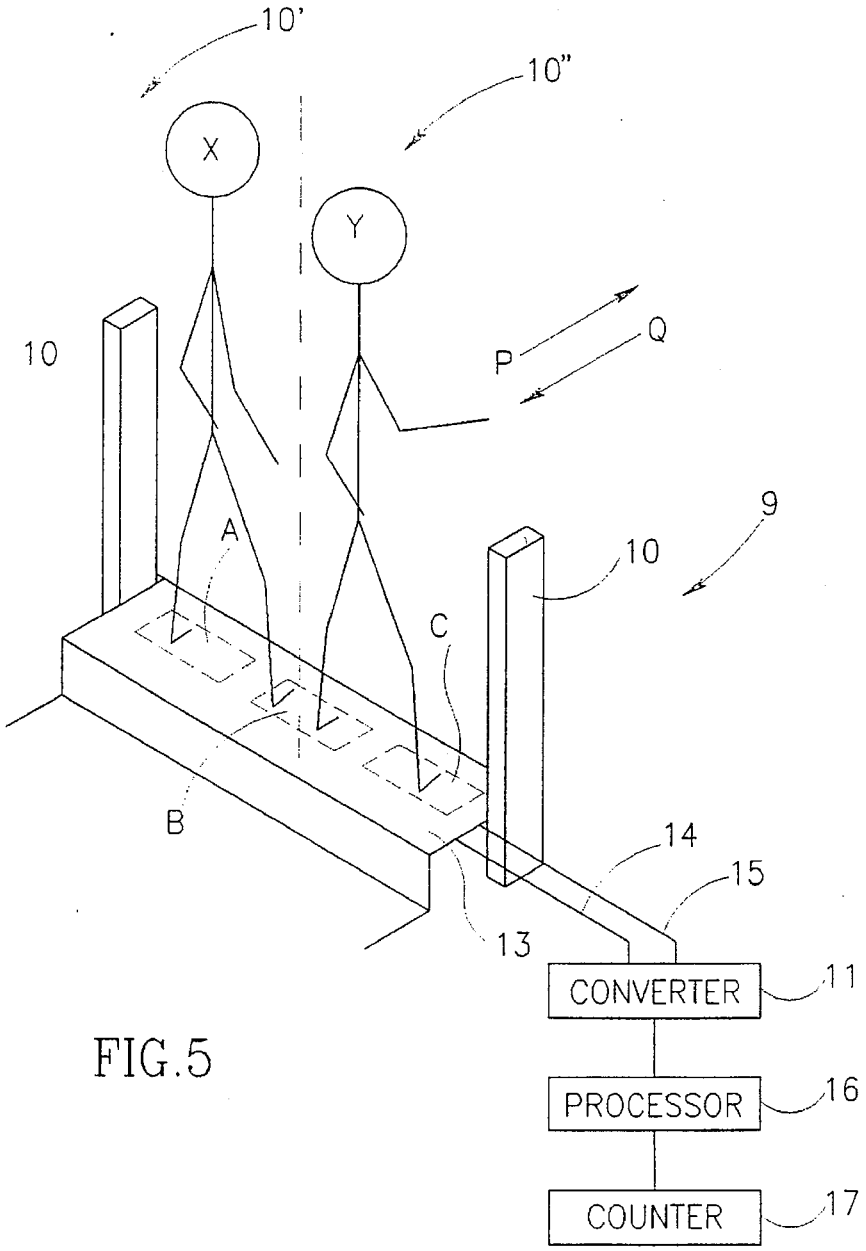
FIG. 5 is a schematic view of a system for counting people passing through a two people wide entry point.

FIG. 5 depicts a system, generally designated 9, for counting the number of people passing through an entry point 10 having a span of between about 1 m to about 1.2 m, thereby enabling a person on the left and a person on the right to pass therethrough simultaneously. For the sake of convenience, a person on the left is hereinafter referred to as X whilst a person on the right is hereinafter referred to as Y. In this case, the system 9 further includes a converter 11 for converting the two people wide entry point 10 into two fictitious single person wide entry points 10' and 10" by use of a converter 11 described hereinbelow with reference to FIGS. 7 and 8. The converter 11 has two output information channels 14 and 15 for providing the pressure profile vectors of the people wholly or partially standing on a platform 13. As before, the system 9 includes a processor 16 for determining from the manner in which a person at least partially steps off the platform 13 whether the person completely passed through the entry point 10 and, in an affirmative case, for incrementing a counter 17 recording the number of people passing through the entry point 10 in a predetermined direction P.

To enable the conversion to be effected by the converter 11, the platform 13 includes three sensor mats A, B and C of the type described in FIG. 2 above deployed so as to extend across the entry point 10. The sensor mats A and C are dimensioned and deployed such that the sensor mat A can only be activated by X's left foot whilst the sensor mat C can only be activated by Y's right foot. In contrast to the sensor mats A and C, the sensor mat B is dimensioned and deployed such that it can be activated by either X's right foot or Y's left foot. Accordingly, the length of the sensor mats A and C is typically in the region of 30 cm whilst the length of the sensor mat B is typically in the region of 40 cm. Typically, the width of the sensor mats A, B and C is similar to the width of the sensor mat 7.

FIG. 6 shows the legend describing the eight possible configurations of feet on the platform 13. In the legend, logic "0" corresponds to a non-activated sensor mat whilst logic "1" corresponds to an activated sensor mat. Thus, as shown, Configuration 0 represents the configuration (0,0,0), Configuration 1 represents the configuration (1,0,0), Configuration 2 represents the configuration (0,1,0), Configuration 3 represents the configuration (1,1,0), Configuration 4 represents the configuration (0,0,1), Configuration 5 represents the configuration (1,0,1), Configuration 6 represents the configuration (0,1,1) and Configuration 7 represents the configuration (1,1,1).

Figure 7C:
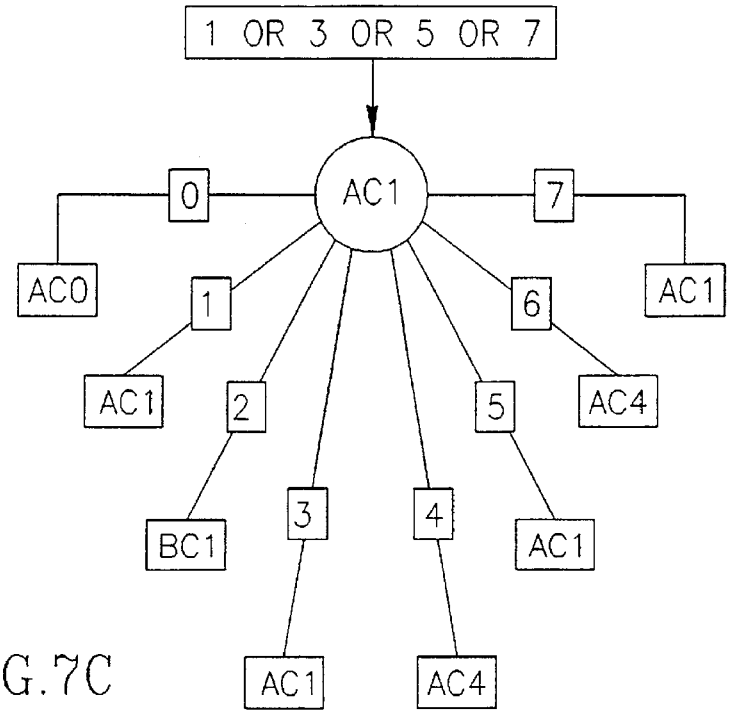
FIG. 7C shows the AC1 state of the converter of the system of FIG. 5.
Figure 7D:
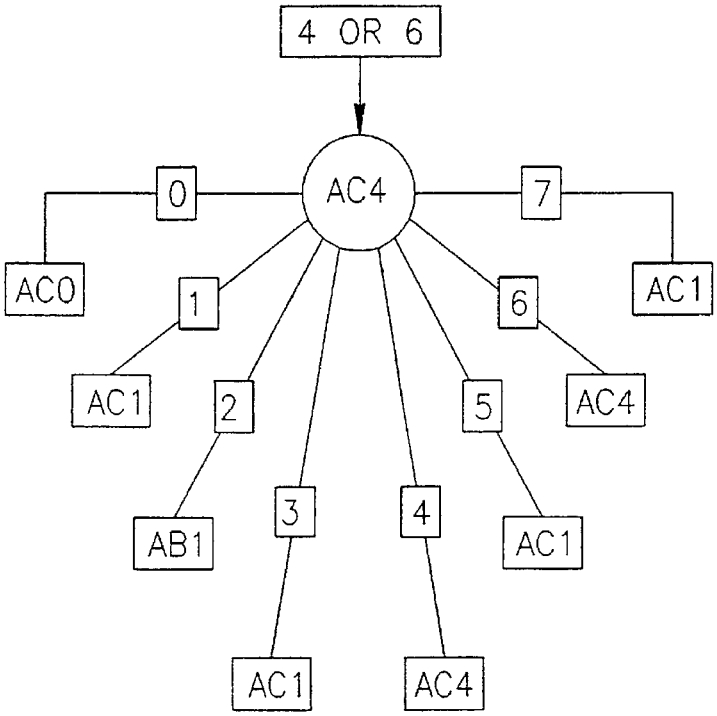
FIG. 7D shows the AC4 state of the converter of the system of FIG. 5.
Figure 7E:
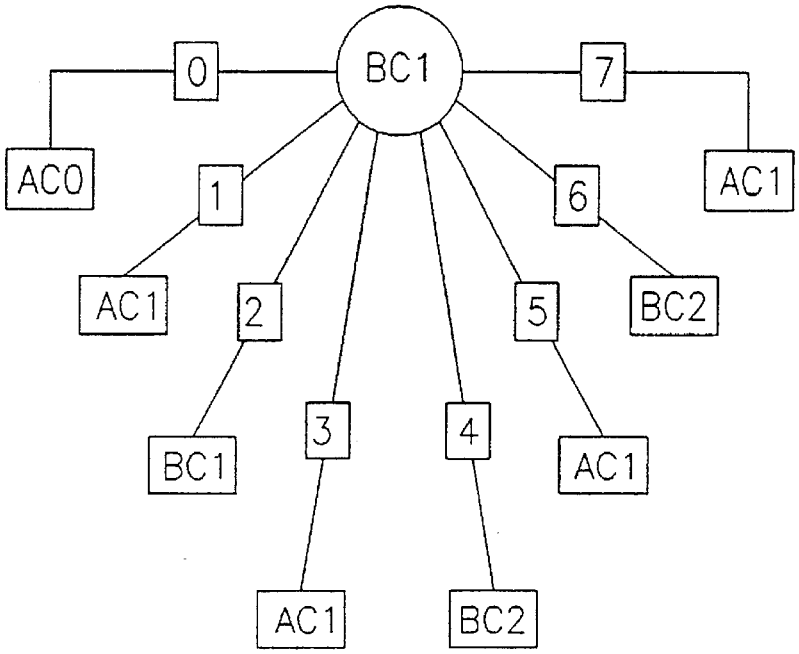
FIG. 7E shows the BC1 state of the converter of the system of FIG. 5.
Figure 7F:
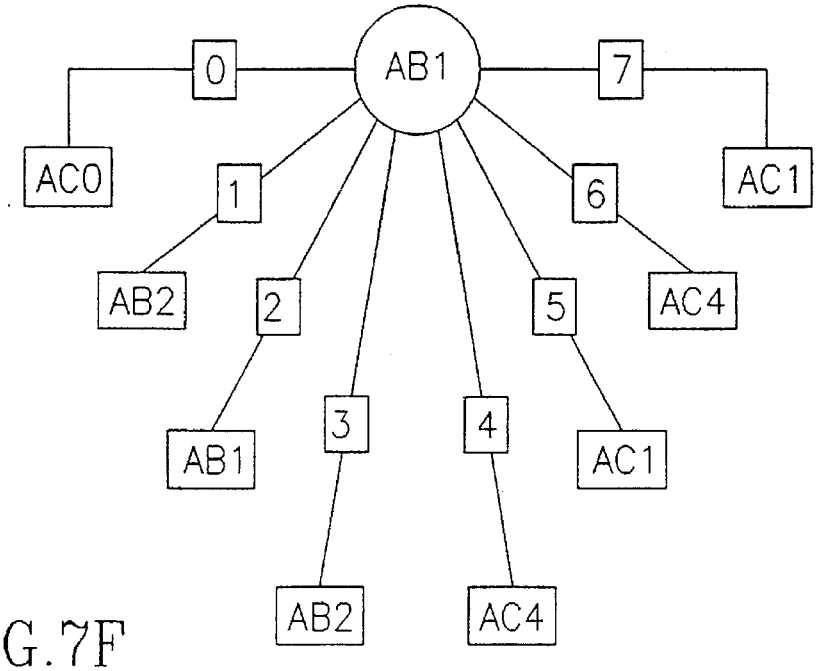
FIG. 7F shows the AB1 state of the converter of the system of FIG. 5.
Figure 7G:
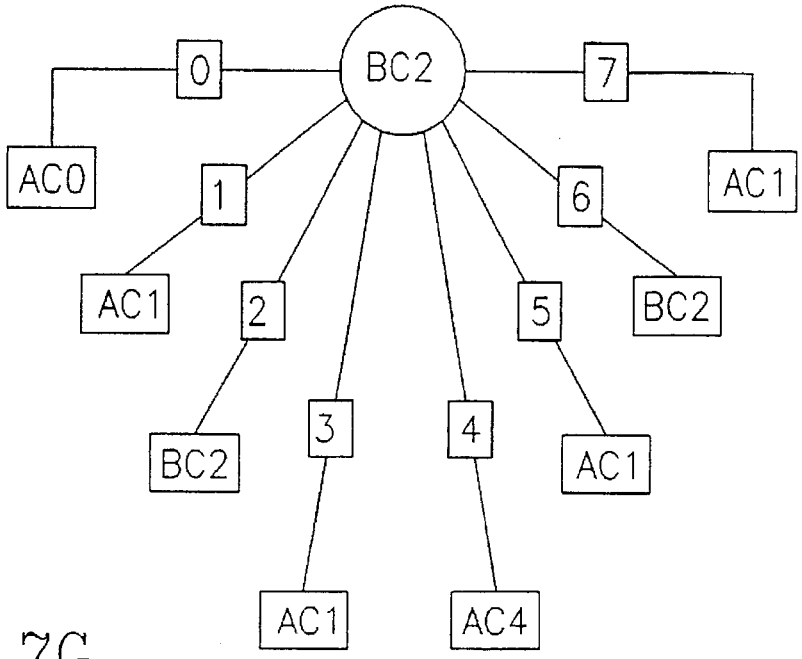
FIG. 7G shows the BC2 state of the converter of the system of FIG. 5.
Figure 7H:
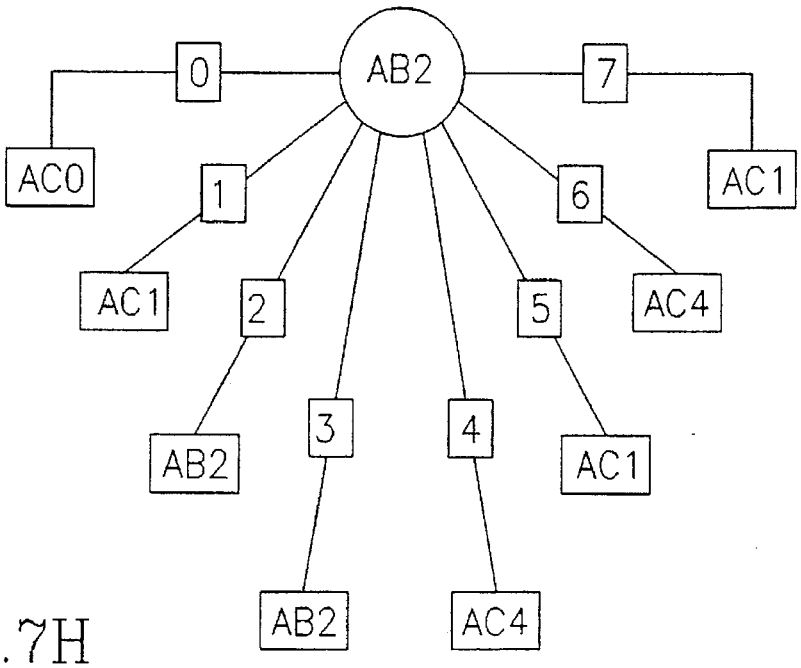
FIG. 7H shows the AB2 state of the converter of the system of FIG. 5.
Figure 7J:
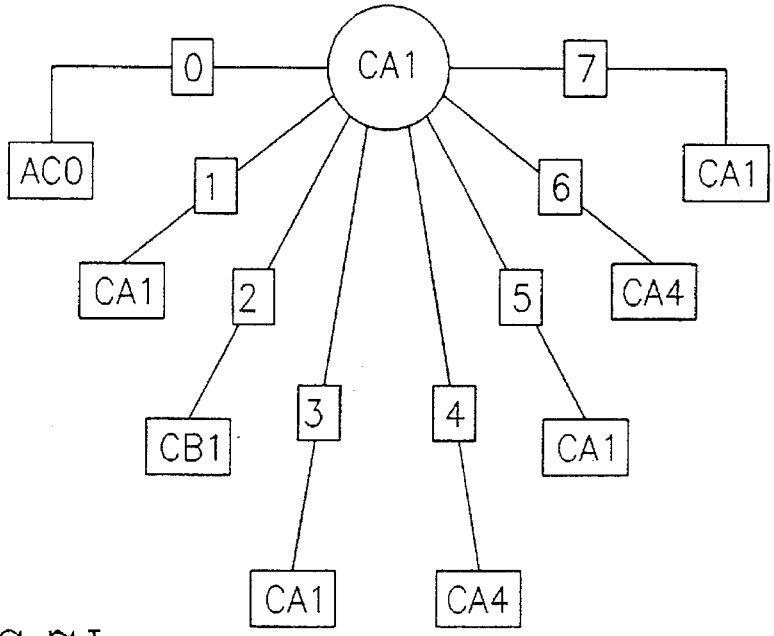
FIG. 7J shows the CA1 state of the converter of the system of FIG. 5.
Figure 7K:
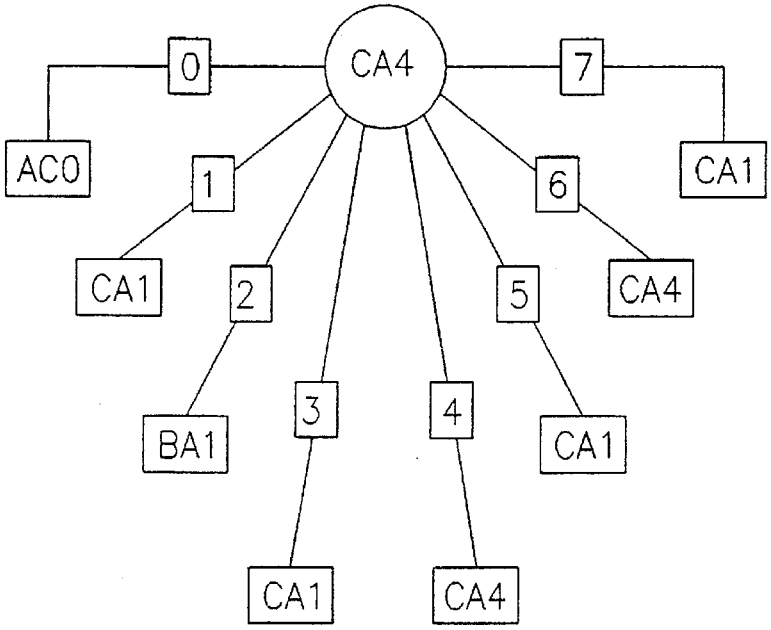
FIG. 7K shows the CA4 state of the converter of the system of FIG. 5.
Figure 7L:
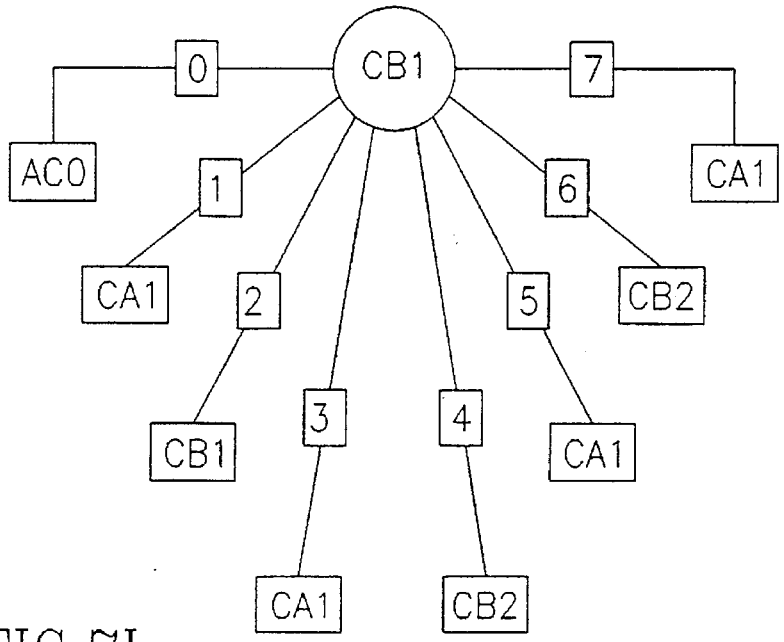
FIG. 7L shows the CB1 state of the converter of the system of FIG. 5.
Figure 7M:
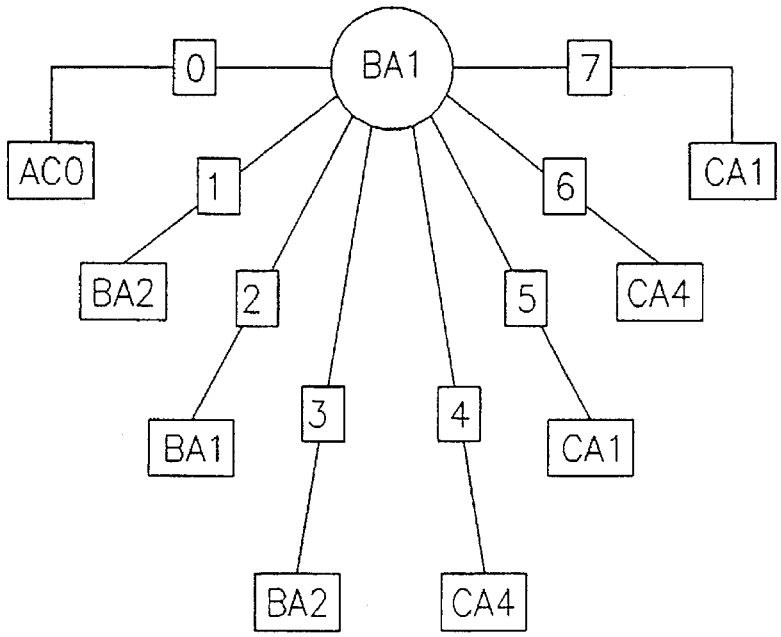
FIG. 7M shows the BA1 state of the converter of the system of FIG. 5.
Figure 7N:
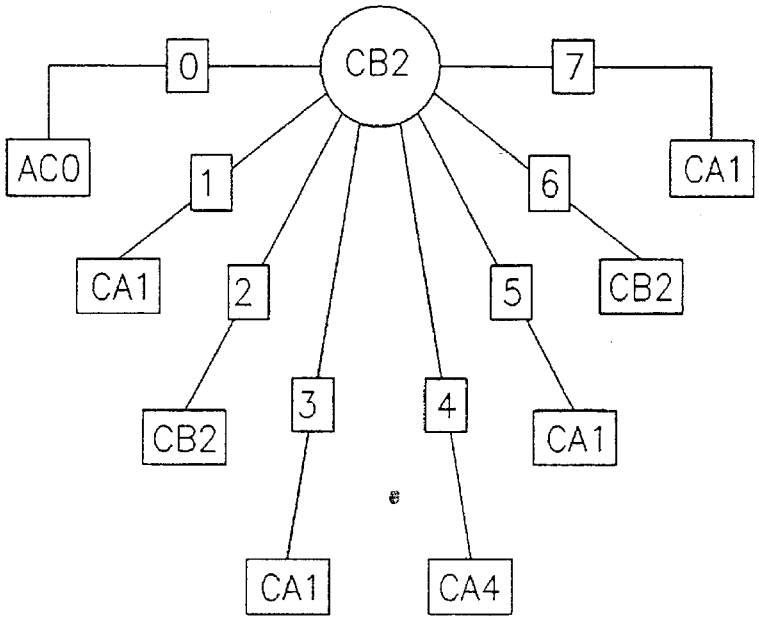
FIG. 7N shows the CB2 state of the converter of the system of FIG. 5.
Figure 7P:
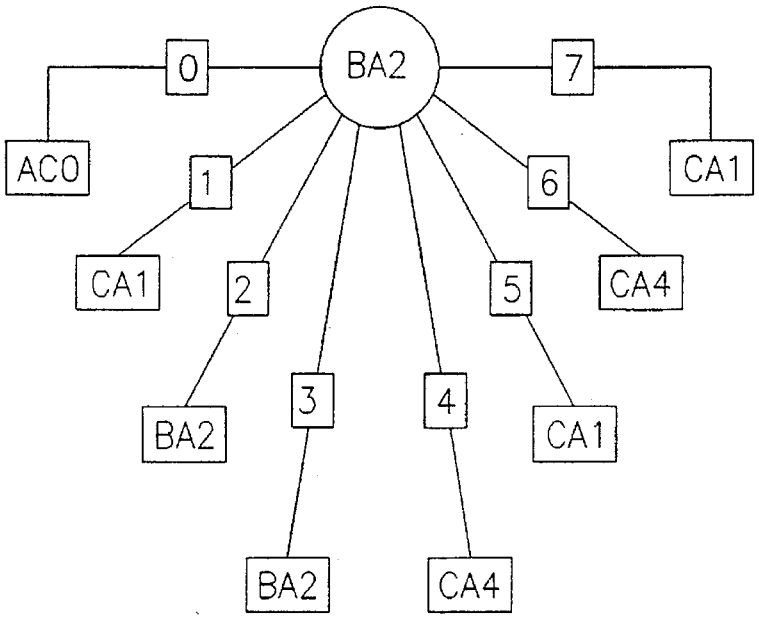
FIG. 7P shows the BA2 state of the converter of the system of FIG. 5.

FIGS. 7A–7P show a finite state machine implementation of the converter 11 for effecting the conversion process of the two person wide entry point 10 into two fictitious one person wide entry points 10' and 10". The converter 11 includes 14 states as follows: AC0 (FIG. 7A), BC0 (FIG. 7B), AC1 (FIG. 7C), AC4 (FIG. 7D), BC1 (FIG. 7E), AB1 (FIG. 7F), BC2 (FIG. 7G), AB2 (FIG. 7H), CA1 (FIG. 7J), CA4 (FIG. 7K), CB1 (FIG. 7L), BA1 (FIG. 7M), CB2 (FIG. 7N) and BA2 (FIG. 7P). The left letter of each state specifies which one of the sensor mats A, B and C is output on the channel 14 whilst the right letter of each state specifies which one of the sensor mats A, B and C is output on the channel 15. Thus, for example, in the state AC0, the sensor mat A is output on the channel 14 and the sensor mat C is output on the channel 15 whilst in the state CA4, the sensor mat C is output on the channel 14 and the sensor mat A is output on the channel 15. The reason that the sensor mat A is sometimes output on the channel 14 and sometimes output on the channel 15 is described hereinbelow.

The flow between the different states of the converter 11 is determined by a transition from an old configuration of activated and non-activated sensor mats to a new configuration of activated and non-activated sensor mats. For example, at the start of a counting procedure when the sensor mats A, B and C are not activated, the converter 11 detects the Configuration 0 (0,0,0) and assumes the state AC0. Thereafter, assuming that X's right foot activates the sensor mat B, the converter 11 detects the Configuration 2 (0,1,0) and assumes the state BC0. And finally, assuming that X's left foot activates the sensor mat A, the converter 11 detects the Configuration 3 (1,1,0) and assumes the state AC1.

It should be noted that the possibility of the transitions, for example, from Configuration 1 (1,0,0) to Configuration 6 (0,1,1), from Configuration 2 (0,1,0) to Configuration 5 (1,0,1), and the like, that require that two or more sensor mats to be either activated or deactivated between samples is highly remote in view of the fast sampling rate of the sensor mats. However, such transitions are handled by the converter 11 so as to enable continuous operation of the converter 11 in such events.

The operation guidelines of the system 9 are summarized as follows:

1. The channel 14 is the default output channel of the sensor mat A and the sensor mat B.
2. The channel 15 is the default output channel of the sensor mat C.
3. X can activate either the sensor mat A or the sensor mat B but not the sensor mat C.
4. Y can activate the sensor mat B or the sensor mat C and but not the sensor mat A.
5. If the sensor mat B is activated and both the sensor mats A and C are not activated, then the sensor mat B is assumed to be activated by X's right foot.
6. A person standing with both feet on the platform 13 is free to decide which foot is his leading foot when stepping off the platform 13.
7. If the sensor mat A is activated and the sensor mats B and C are not activated, then the decision as to the manner in which X steps off the platform 13 is determined with respect to his left foot.
8. If the sensor mat B is activated and the sensor mats A and C are not activated, then the decision as to the manner in which X steps off the platform 13 is determined with respect to his right foot.
9. If the sensor mat C is activated and the sensor mats B and C are not activated, then the decision as to the manner in which Y steps off the platform 13 is determined with respect to his right foot.
10. If the sensor mats A and B are activated and the sensor mat C is not activated, then the decision as to the manner in which X steps off the platform 13 is determined with respect to his trailing foot.
11. If the sensor mats B and C are activated and the sensor mat A is not activated, then the decision as to the manner in which Y steps off the platform 13 is determined with respect to his trailing foot.
12. If the sensor mats A and C are activated and the sensor mat B is not activated, then the decision as to the manner in which X steps off the platform 13 is determined with respect to his left foot and the decision as to the manner in which Y steps off the platform 13 is determined with respect to his right foot.
13. If the sensor mats A, B and C are activated, then the decision as to the manner in which X steps off the platform 13 is determined with respect to the sensor mat A irrespective of which foot is his leading foot when stepping off the platform 13.
14. If the sensor mats A, B and C are activated, then the decision as to the manner in which Y steps off the platform 13 is determined with respect to the sensor mat C irrespective of which foot is his leading foot when stepping off the platform 13.

The operation of the system 9 is now described for the scenario shown in FIG. 8 in which $X_1$, $X_2$, $Y_1$ and $Y_2$ participate.

Line 1 The platform 13 is evacuated corresponding to the Configuration 0 (0,0,0). The converter 11 assumes the state AC0 specifying that the sensor mat A is output on the channel 14 and the sensor mat C is output on the channel 15. The counter 17 is set to zero.

Line 2 $X_1$ places his left foot on the sensor mat A. The platform 13 assumes the Configuration 1 (1,0,0). The converter 11 assumes the state AC1. As before, the sensor mat A is output on the channel 14 and the sensor mat C is output on the channel 15.

Line 3 $X_1$ places his right foot on the sensor mat B. The platform 13 assumes the Configuration 2 (1,1,0). The converter 11 maintains the state AC1.

Line 4 $X_1$ takes a step forward with his left foot. The platform 13 assumes the Configuration 2 (0,1,0). The converter 11 assumes the state BC1 specifying that the sensor mat B is output on the channel 14 and the sensor mat C is output on the channel 15. No decision as to the direction in which $X_1$ stepped off the platform 13 is made at this time as the converter 11 is aware that $X_1$'s trailing foot is still on the sensor mat B.

Line 5 $Y_1$ places his left foot on the sensor mat B. $Y_1$'s left foot has no effect on the prevailing Configuration 2 (0,1,0) of the platform 13 and therefore the converter 11 maintains the state BC1.

Line 6 $Y_1$ places his right foot on the sensor mat C. The platform 13 assumes the Configuration 6 (0,1,1). The converter 11 assumes the state BC2. As before, the sensor mat B is output on the channel 14 and the sensor mat C is output on the channel 15.

Line 7 $Y_1$ steps backward with his left foot. $Y_1$'s left foot has no effect on the prevailing Configuration 6 (0,1,1) of the platform 13 and therefore the converter 11 maintains the state BC2.

Line 8 $Y_1$ completes his step backward. The platform 13 assumes the Configuration 2 (0,1,0). The converter 11 assumes the state BC1. In this case, the processor 16 determines that $Y_1$ did not pass through the entry point 10 from the manner in which he stepped off the platform 13 with his trailing left foot.

Line 9 $X_1$ completes his step forward. The platform 13 assumes the Configuration 0 (0,0,0). The converter 11 assumes the state AC0. In this case, the processor 16 determines that $X_1$ did pass through the entry point 10 from the manner in which he stepped off the platform 13 with his trailing right foot and increments the counter 17 to one.

Line 10 $Y_2$ places his left foot on the sensor mat B. The platform 13 assumes the Configuration 2 (0,1,0). The converter 11 assumes the state BC0 specifying that the sensor mat B is output on the channel 14 and the sensor mat C is output on the channel 15. The sensor mat B is initially associated with X.

Line 11 $Y_2$ places his right foot on the sensor mat C. The platform 13 assumes the Configuration 6 (0,1,1). The converter 11 assumes the state CA4 specifying that the sensor mat C is output on the channel 14 and the sensor mat A is output on the channel 15. The fact that the sensor mat C replaces the sensor mat B for output on the channel 14 is by virtue that the converter 11 assumes that the sensor mat B was activated by $Y_2$'s left foot and defaults to employing his right foot for determining the direction in which he steps off the platform 13.

It should be noted that the converter 11 does not assume one of the states in which the sensor mat A is output on the channel 14 and the sensor mat C is output on the channel 15 as this indicate that the now known to be fictitious X has stepped off the platform 13, thereby rendering an incorrect count.

Line 12 $X_2$ places his right foot on the sensor mat B. $X_2$'s right foot has no effect on the prevailing Configuration 6 (0,1,1) of the platform 13 and therefore the converter 11 maintains the state CA4.

Line 13 $X_2$ places his left foot on the sensor mat A. The platform 13 assumes the Configuration 7 (1,1,1). The converter 11 assumes the state CA1. As before, the sensor mat C is output on the channel 14 and the sensor mat A is output on the channel 15.

Line 14 $X_2$ takes a step forward with his right foot. $X_2$'s right foot has no effect on the prevailing Configuration 7 (1,1,1) of the platform 13 and therefore the converter 11 maintains the state CA1.

Line 15 $Y_2$ takes a step forward with his left foot. The platform 13 assumes the Configuration 5 (1,0,1). The converter 11 maintains the state CA1. No decision as to the direction in which $Y_2$ stepped off the platform 13 is made at this time as the converter 11 is aware that $Y_2$'s trailing foot is still on the sensor mat C.

Line 16 $X_2$ completes his step forward. The platform 13 assumes the Configuration 4 (0,0,1). The converter 11 assumes the state CA4. In this case, the processor 16 determines that $X_2$ did pass through the entry point 10 from the manner in which he stepped off the platform 13 with his trailing left foot arid increments the counter 17 to two.

Line 17 $Y_2$ completes his step forward. The platform 13 assumes the Configuration 0 (0,0,0). The converter 11 assumes the state AC0. In this case, the processor 16 determines that $Y_2$ did pass through the entry point 10 from the manner in which he stepped off the platform 13 with his trailing right foot and increments the counter 17 to three.

While the invention has been described with respect to a limited number of embodiments, it will be appreciated that many variations, modifications and other applications of the invention can be made by those ordinarily skilled in the art.

We claim:

1. A system for counting the number of people passing a entry point in a predetermined direction, the system comprising:

(a) a foot-activated, pressure sensitive platform deployed at the entry point for providing a time-dependent pressure profile vector indicative of the manner in which a person arches one of his feet prior to at least partially stepping off said platform;

(b) a processor for processing said pressure profile vector for determining whether the person completely passed through the entry point in the predetermined direction; and (c) a counter coupled to said processor for recording the number of people completely passing through the entry point in the predetermined direction.

2. The system according to claim 1 wherein said platform includes a plurality of pressure sensitive sensors deployed along the direction of passage of people through the entry point so as to provide a sequence of signals in which each signal provides an instantaneous pressure footprint of a person.

3. The system according to claim 2 wherein said processor processes at least four signals for determining whether an arching of a foot is indicative of a complete passage of a person through the entry point in the predetermined direction.

4. The system according to claim 1 wherein the system is adapted for providing a net count that reflects the instantaneous number of people in a given area during entering and leaving of people through the entry point into and from the given area by means of said processor detecting a complete passage of a person through the entry point in a first direction or a second direction opposite to said first direction.

5. The system according to claim 1 wherein said platform is dimensioned such that it can be activated by either the left foot or the right foot of only a single person at any one time so as to enable counting of people passing through an entry point enabling single file passage therethrough only.

6. The system according to claim 1 wherein the system further comprises a converter for converting a predetermined number of people wide entry point into an equivalent number of single person wide entry points so as to enable counting of people passing through a two or more person wide entry point.

7. The system according to claim 1 wherein said platform includes an array of sensors deployed along the direction of the passage of people through the entry point and wherein each sensor extends in a transverse direction to the direction of the passage of people through the entry point.

8. The system according to claim 1 wherein said platform includes a matrix of substantially uniformly dispersed dot sensors.

9. The system according to claim 1 wherein said platform includes open/close switches.

10. The system according to claim 1 wherein said platform includes continuous pressure reading output devices.

11. A method for counting the number of people passing through an entry point in a predetermined direction, the method comprising the steps of:

(a) providing a time-dependent pressure profile vector indicative of the manner in which a person arches one of his feet prior to at least partially stepping of a platform;

(b) processing the pressure profile vector for determining whether the person completely passed through the entry point in the predetermined direction; and (c) incrementing a counter for providing a cumulative count of the number of people passing through the entry point in the predetermined direction.

12. The method according to claim 11 wherein the step of processing processes at least four signals of the arching of a foot prior to at least a partial step off from the platform for determining whether a person completely passed through the entry point in the predetermined direction.

13. The method according to claim 11 wherein the method is adapted for providing a net count that reflects the instantaneous number of people in a given area during the entering and leaving of people through an entry point into and from the given area by means of the step of processing detecting a complete passage of a person through the entry point in a first direction or a second direction opposite to the first direction.

14. The method according to claim 11 wherein the platform is dimensioned such that it can be activated by either the left foot or the right foot of only a single person at any one time so as to enable counting of people passing through an entry point enabling single file passage therethrough only.

15. The method according to claim 11 wherein further comprising the step of converting a predetermined number of people wide entry point into an equivalent number of single person wide entry points so as to enable counting of people passing through a two or more person wide entry point.

* * * * *